US006527149B1

(12) United States Patent
Garcia et al.

(10) Patent No.: US 6,527,149 B1
(45) Date of Patent: Mar. 4, 2003

(54) FIXING ELEMENT FOR DISPENSING A LIQUID PRODUCT AND DISPENSER COMPRISING SAID ELEMENT

(75) Inventors: Firmin Garcia, Evreux (FR); Stéphane Beranger, Surtauville (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 09/958,304

(22) PCT Filed: Mar. 20, 2000

(86) PCT No.: PCT/FR00/00686

§ 371 (c)(1),
(2), (4) Date: Oct. 9, 2001

(87) PCT Pub. No.: WO00/63094

PCT Pub. Date: Oct. 26, 2000

(30) Foreign Application Priority Data

Apr. 16, 1999 (FR) ..... 99 04770

(51) Int. Cl.[7] ..... B67D 5/42
(52) U.S. Cl. ..... 222/321.9
(58) Field of Search ..... 222/1, 182, 321.7, 222/321.9, 383.1, 385

(56) References Cited

U.S. PATENT DOCUMENTS 3,937,366 A * 2/1976 Steiman ..... 222/321.9
4,932,569 A * 6/1990 Ruscitti et al. ..... 222/321.9
5,271,532 A * 12/1993 Jumel et al. ..... 222/321.9
5,277,340 A 1/1994 Van Brocklin
5,341,956 A * 8/1994 Van Brocklin ..... 222/321.9
5,845,819 A * 12/1998 de Pous ..... 222/321.9
6,010,039 A * 1/2000 Bougamont ..... 222/321.7
6,073,805 A * 6/2000 Gueret ..... 222/321.7
6,186,370 B1 * 2/2001 de Pous et al. ..... 222/321.9
6,247,613 B1 * 6/2001 Meshberg ..... 222/1
6,279,786 B1 * 8/2001 de Pous et al. ..... 222/321.9

FOREIGN PATENT DOCUMENTS

DE 31 22 982 A 12/1982
EP 0 339 125 A 11/1989
EP 0 390 717 A 10/1990

* cited by examiner

*Primary Examiner*—Kenneth Bomberg
(74) *Attorney, Agent, or Firm*—Sughrue Mion, PLLC

(57) ABSTRACT

A fluid dispenser having a receptacle with a neck (10); a dispensing member (2); and a fixing member (3; 2) for fixing the dispensing member (2) to the neck (10) of the receptacle (1). The fixing member cooperates with the inside wall of the neck, which is provided with a notch (12) that extends over a portion of the periphery of the neck, and the fixing member provided with snap-fastening means (32; 22) and with a skirt (30, 20) that engages in the neck of the receptacle. The snap-fastening means has an outside radial projection (32; 22) received in the notch in the inside wall of the neck. The snap-fastening means further has a locking ring (4; 20; 61) engaged in the skirt to the level of the notch (12) in the inside wall of the neck.

15 Claims, 4 Drawing Sheets

Figure 1:
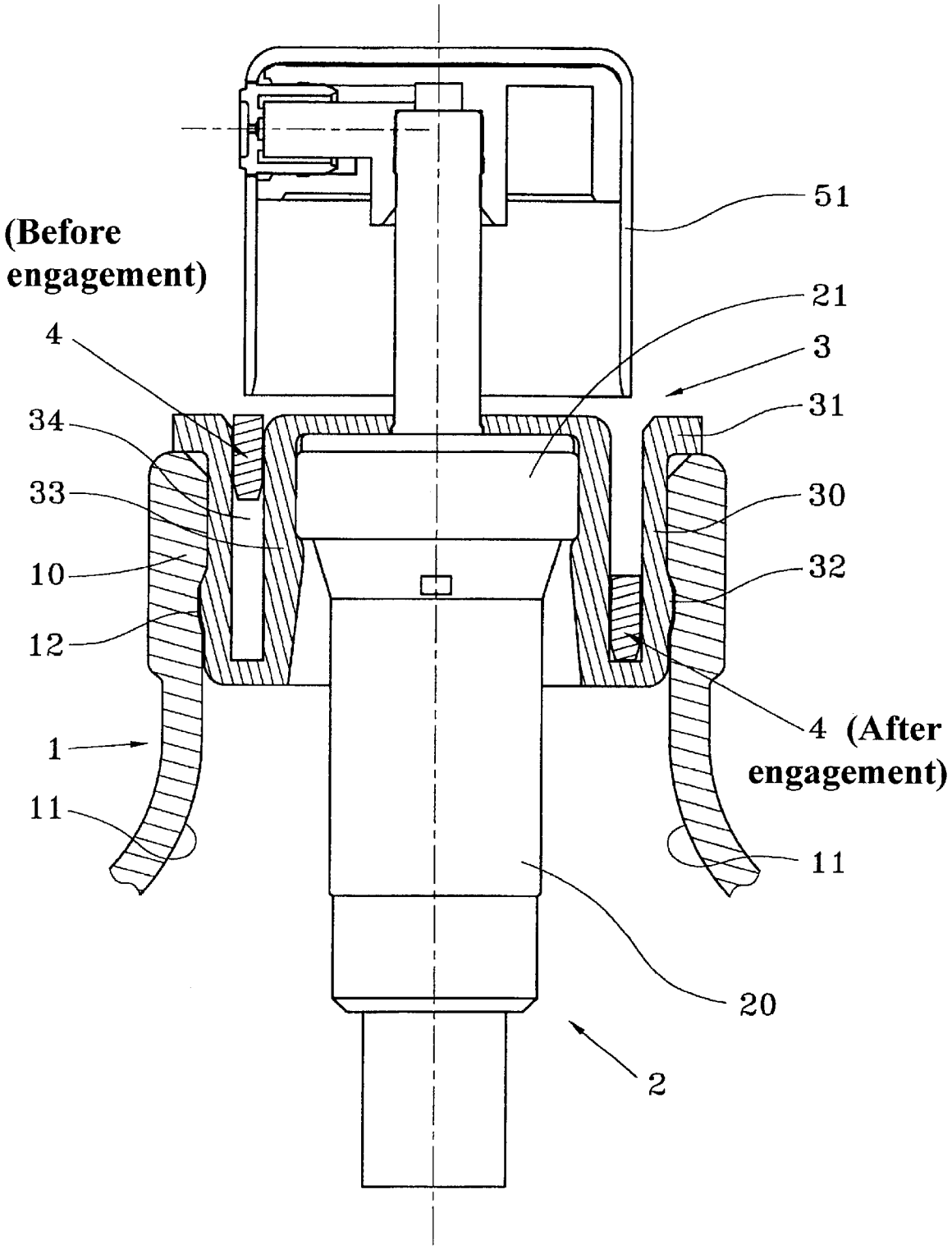

FIXING ELEMENT FOR DISPENSING A LIQUID PRODUCT AND DISPENSER COMPRISING SAID ELEMENT

The present invention relates to a fluid dispenser comprising a receptacle provided with a neck, and a dispensing member such as a pump or a valve. A fixing member is provided for fixing the pump or the valve to the neck of the receptacle. This is an entirely conventional design for a dispenser in the fields of perfumes, cosmetics, or indeed pharmaceuticals. This type of dispenser is actuated by pressing with a finger on a pusher which moves an actuating rod inside the body of the pump or of the valve. As a result, a metered quantity or a continuous jet of fluid is dispensed.

In the prior art, there exist numerous techniques for fixing a pump or a valve to the neck of a receptacle. The most commonly used techniques are snap-fastening, crimping, and screwing. For that purpose, a fixing member is used that is often in the form of a ring or a turret that co-operates with the outside wall of the neck of the receptacle. In general, the neck is provided with a thickened outside rim which extends over a certain height of the neck or which can also be provided with an outside thread serving to co-operate with an inside thread formed inside the fixing member. To hold the pump or the valve, the fixing member is provided with a recess in which the pump or the valve is often received by snap-fastening. Thus, the fixing member forms a transition between the pump or the valve and the neck of the receptacle.

In the prior art devices, since the fixing member co-operates with the outside wall of the neck of the receptacle, the fixing member must have a relatively large diameter, which sometimes spoils the appearance of the dispenser, in particular in the field of perfumes.

Prior art devices that solve that problem already exist. For example, reference may be made to Document U.S. Pat. No. 5,277,340 which describes a dispenser in which the pump is fixed by means of a fixing ring that co-operates with the inside wall of the neck of the reservoir. For that purpose, the inside wall of the neck of the reservoir is provided with a notch in which a sleeve formed by the fixing ring is received. The sleeve is resilient so that it can be stressed and can then relax inside the notch formed in the inside wall of the neck of the reservoir. It is thus possible to fix a pump inside a reservoir without the fixing ring being visible from the outside.

Reference may be also be made to Document U.S. Pat. No. 3,937,366 which describes a distributor in which the pump is also fixed by means of a fixing ring inside a reservoir neck. In a manner similar to the above-mentioned document, the inside wall of the neck defines a groove in which a bead on the fixing ring is snap-fastened.

Unfortunately, those prior art devices suffer from the drawback that the snap-fastening in the neck is not entirely stable, or secure if the pump is pulled outwards.

An object of the present invention is thus to remedy that prior art drawback by defining a dispenser in which the inside snap-fastening of the fixing ring is definitive and entirely stable.

To this end, the present invention provides a fluid dispenser comprising:

- a receptacle containing the fluid, said receptacle having a neck defining an inside wall;
- a dispensing member such as a pump or a valve; and
- a fixing member for fixing the dispensing member to the neck of the receptacle;
- the fixing member co-operating with the inside wall of the neck, said inside wall of the neck being provided with at least one notch which extends over at least a portion of the periphery of the neck, and the fixing member being provided with snap-fastening means suitable for being received in said notch in the inside wall of the neck, said fixing member being provided with a skirt serving to be engaged in the neck of the receptacle, the snap-fastening means comprising an outside radial projection suitable for coming to be received in said notch in the inside wall of the neck;
- the snap-fastening means further comprising a locking ring engaged by force in the skirt to the level of the notch in the inside wall of the neck.

The locking ring, which must naturally be made of a rigid, non-deformable material, may be constituted by a separate element, but it may also be constituted by an element of the dispensing member. The locking ring may be formed by the body of the dispensing member, by a separate ring, but also by a ferrule engaged by force in the body of the dispensing member.

As regards the fixing member, it may be formed by a fixing ring independent of the dispensing member, but it may also be formed by the body of the dispensing member itself. In which case, the locking ring must be formed by the ferrule engaged in the body of the dispensing member. In particular, it is advantageous to use such a ferrule because it is an element that is particularly rigid and that does not tend to deform. In general, the ferrule defines the rest position of the piston, i.e. its top dead center. When the fixing member is formed by a separate fixing ring, it is advantageous for the body of the dispensing member to be slidably received in tight-fitting manner in the skirt. It is then possible, when assembling the dispenser, firstly to engage the fixing ring in the neck so that the radial projection comes to be received in the notch, and then to engage the dispensing member in the ring so as to position the ferrule at the level of the projection, thereby locking the snap-fastening of the fixing ring in the notch formed in the inside wall of the neck of the reservoir. It is then possible to deliver the dispenser member with its body partially engaged in the fixing member. The person in charge of filling and assembling the dispensing member then merely needs to proceed in the manner indicated above.

According to another advantageous characteristic of the invention, the fixing member forms a recess in which a nozzle is received. It is also possible for the fixing member to form a swirl chamber and swirl channels. Similarly, the fixing member may form an outlet channel for the fluid. It is thus possible to omit any additional part for performing these functions. The body of the dispensing member is also simplified.

According to another characteristic, the fixing member is covered with a trim band. Preferably, when the fixing member forms a recess for a nozzle, the trim band is provided with a hole at the level of the nozzle.

According to another characteristic, the fixing member is provided with an outside collar serving to come into abutment against the top edge of the neck, optionally with a gasket being interposed.

The invention is described more fully below with reference to the accompanying drawings which give embodiments of the invention by way of non-limiting example.

Figures 2A, 2B:
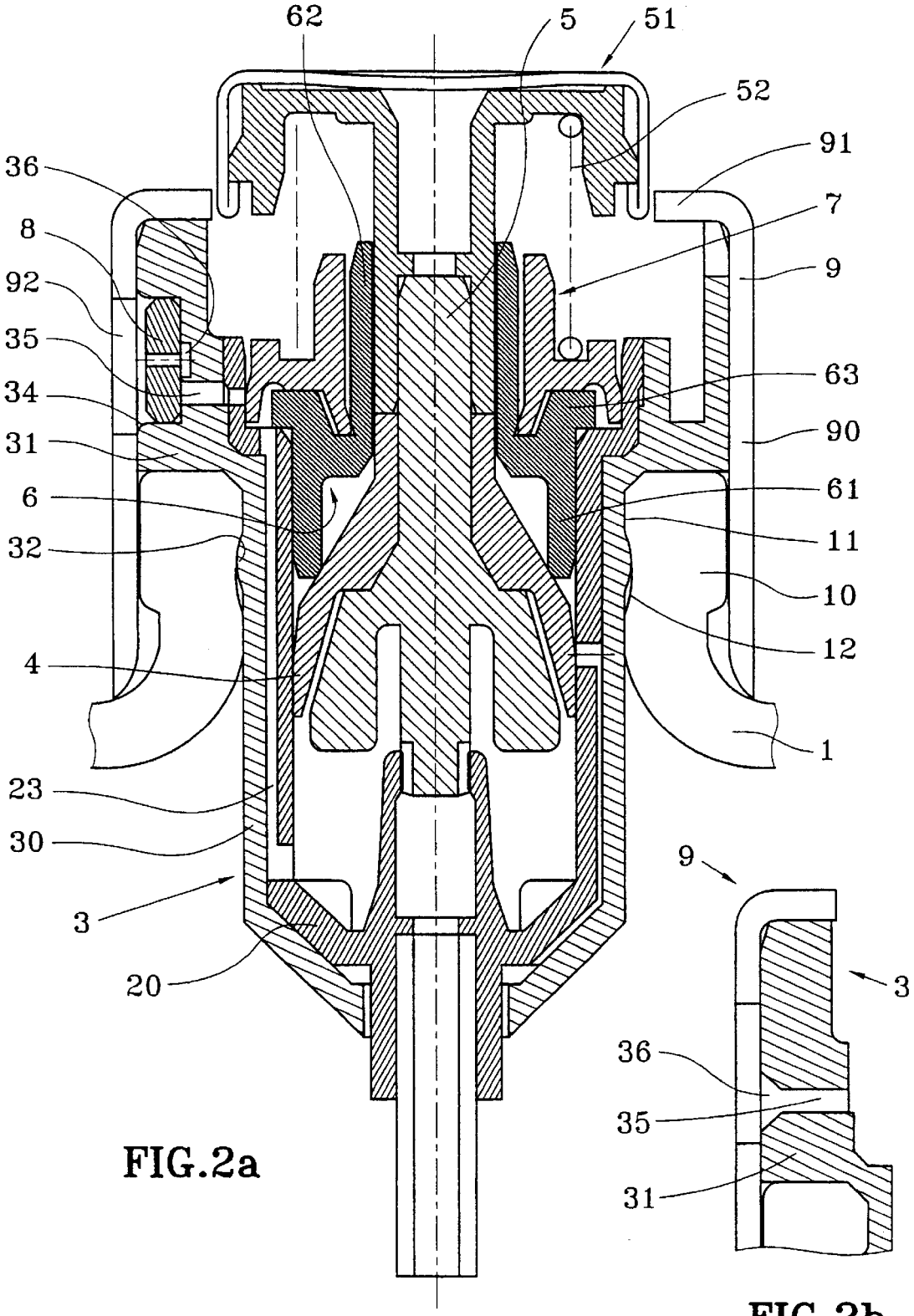
Figures 3A, 3B, 3C:
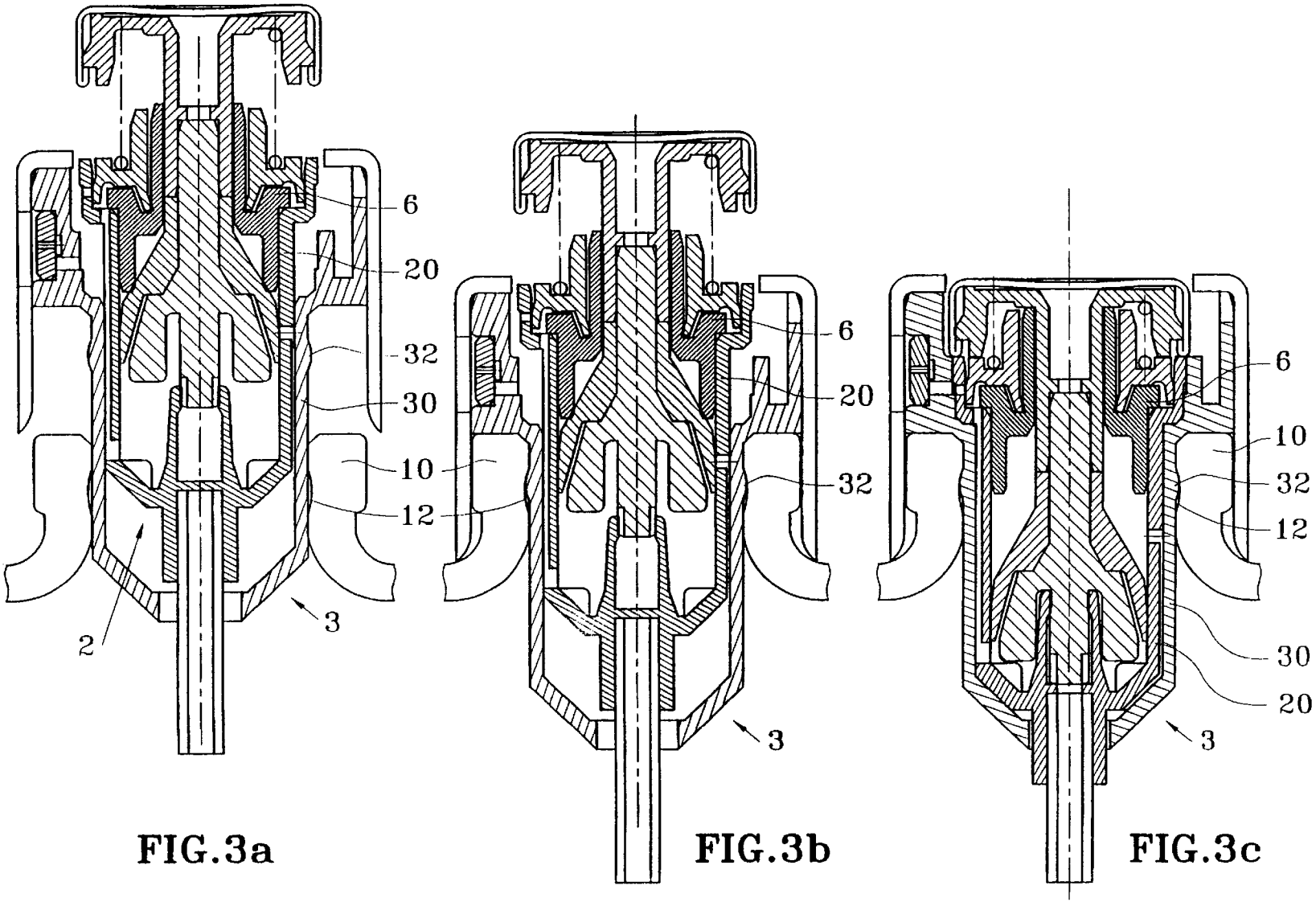
Figure 5:
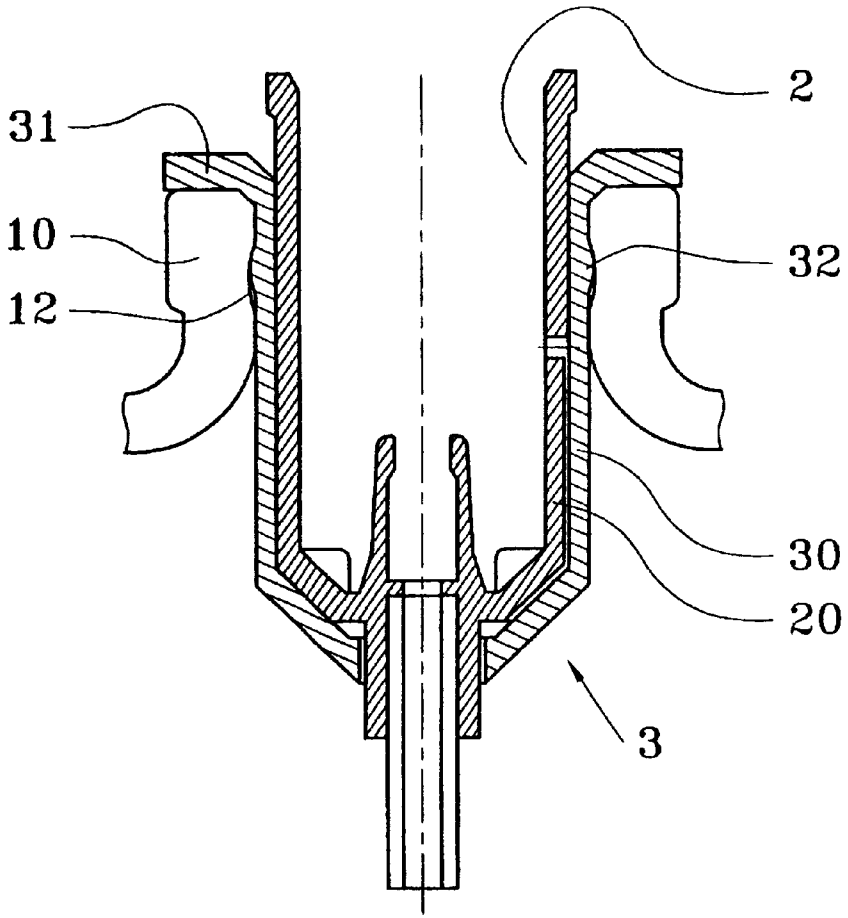
Figure 4:
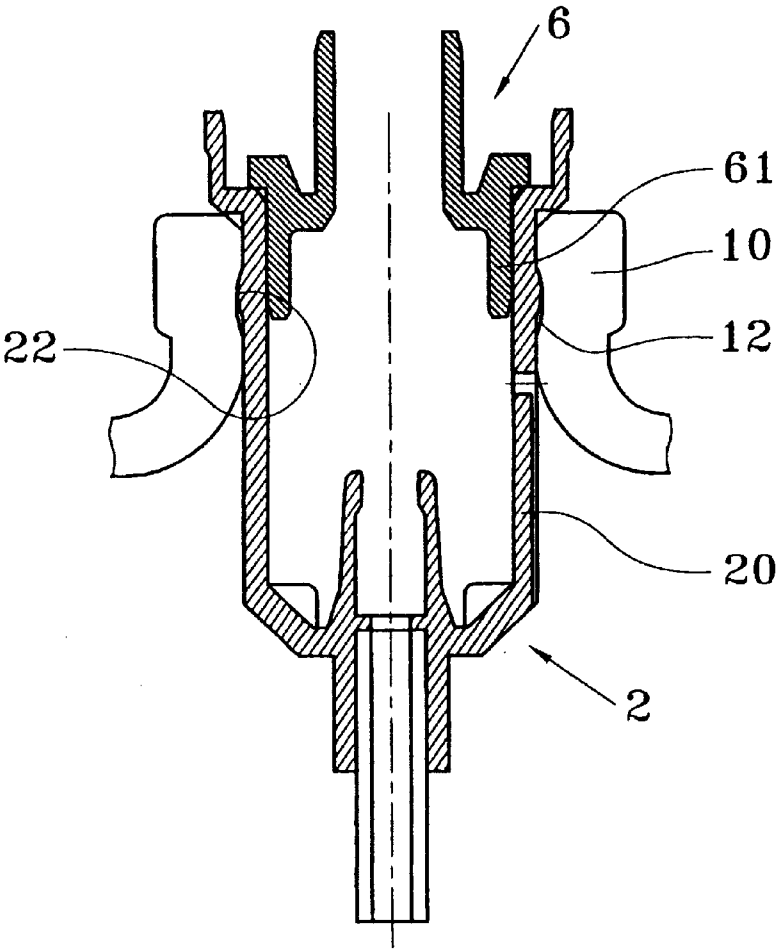

In the drawings:

FIG. 1 is a view in vertical section through a first embodiment of a dispenser of the invention;

FIG. 2*a* is a view in section through a second embodiment;

FIG. 2*b* is a view in section through the top portion of a variant embodiment of the fixing member;

FIGS. 3*a*, 3*b*, and 3*c* are views of the dispenser of FIG. 2*a*, during the various stages of assembly; and FIGS. 4 and 5 are views in section through two other embodiments.

In all of the embodiments, the dispenser includes a receptacle 1 defining a neck 10. The inside wall 11 of the neck 10 is provided with at least one notch 12 which extends peripherally.

The dispenser also includes a pump 2 defining a body 20, and a pusher 51 for actuating the pump. A pump is chosen to illustrate the present invention, but a valve could also have been used.

In the dispenser of FIG. 1, the body 20 defines a thickened collar 21 in snap-fastening engagement in a fixing ring 3 which co-operates with the inside wall 11 of the neck to fix the pump in the neck. The ring 3 is provided with a skirt 30 which extends in contact with the inside wall 11 of the neck 10. In the invention, the outside wall of the skirt 30 is provided with at least one outside radial projection 32 suitable for being received in the notch 12 provided in the inside wall 11 of the neck 10. To limit the extent to which the skirt 30 is engaged in the neck 10, and to set its position therein, the ring 3 is provided with a collar 31 suitable for coming into abutment against the top end of the neck 10.

According to another characteristic of the invention, the skirt 30 is connected to a bushing 33 so that the skirt and the bushing define a cylindrical annular recess 34 between them. The bushing 33 further defines a snap-fastening recess for receiving the collar 21 of the body 20.

In the invention, a locking ring 4 is engaged by force into the recess 34 to the level of the projection 32 formed by the skirt 30, as shown on the right of FIG. 1. The locking ring 4 is made of a non-deformable rigid material, and it definitively locks the snap-fastening of the fixing ring inside the neck 10 of the receptacle 1.

To assemble this dispenser, the procedure is as follows. Firstly, the fixing ring 3 is engaged into the neck 10 until the projection 32 snap-fastens into the recess 12. The locking ring 4 is then engaged by force into the recess 34 to the level of the projection 32. The pump 2 is then fixed definitively.

A second embodiment of the invention is explained below with reference to FIGS. 2*a*, 3*a*, 3*b*, and 3*c*. The dispenser in this embodiment also includes a pump having a body 20 which slidably receives a piston 4 mounted on an actuating rod 5 that is capped with a pusher 51 that is depressed to displace the piston inside the body 20.

To fix the pump in the neck 11 of a receptacle 1, a fixing member 3 is also provided in the form of a ring provided with a skirt 30 and with a collar 31 suitable for coming into abutment against the top end of the neck 10. The skirt 30 extends around the body 20 that it fits tightly and in leaktight manner.

As in the preceding embodiment shown in FIG. 1, the inside wall 11 of the neck 1 is provided with a notch 12, and the outside wall of the skirt is provided with at least one projection or bulge 32 that is received in the notch 12.

In this embodiment, the pump includes a ferrule 6 which is engaged by force in the body 20. The ferrule 6 is provided with a ring 61, an abutment collar 63, and a sheath 62. It is the ring 61 that is engaged by force into the body until the abutment collar 63 comes into abutment against the top end of the body and more precisely against a shoulder formed by the body 20. The sheath 62 serves firstly as guide means for guiding the actuating rod 5, and secondly as a leaktight slideway surface for the outlet valve 7 which is in the form of a differential piston urged by a spring 52 which serves both as a return spring and as a pre-compression spring.

In the invention, the ferrule 6, or more precisely the ring 61 of the ferrule 6 serves as a locking ring for locking the snap-fastening of the bulge 32 in the notch 12 in the neck 10. The ferrule 6 is a relatively rigid part, and its ring 61 has a wall thickness that is relatively large (FIG. 2*a*) so that it does not tend to be deformed, whereas the body 20 of the pump is often made of a thinner and more flexible plastics material which is deformed. That is why the body of the pump 20 alone is not sufficient to lock the snap-fastening of the ring 3 in the neck 10. In certain cases, it is however possible to make a pump body 20 that is sufficiently rigid to enable the ferrule 6 to be omitted for the definitive locking. Such an embodiment is shown in FIG. 5.

FIG. 2*a* shows that the ring 61 extends downwards to the level of the bulge 32 as engaged in the notch 12. The bottom end of the ring 61 also serves as an abutment surface for the piston 4 as in the rest position, i.e. at top dead center, in which the pump chamber has its maximum volume.

In this embodiment, the pump is a fixed-spray pump, i.e. the spray nozzle 8 is not mounted on the pusher 51, but rather on a fixed member of the pump. In this example, it is the fixing ring 3 that forms a recess 34 in which the nozzle 8 is mounted. The fixing ring 3 may also form a swirl chamber and swirl channels 36, as well as an outlet duct 35 that communicates with the swirl channels 36.

The fact that the nozzle is mounted on this fixing member, and more generally on any fixing member, regardless of whether it co-operates with the inside wall of the neck or with the outside wall thereof, or with any fixed member, is an advantageous characteristic which may be implemented independently because the fixing member is snap-fastened in the neck of the receptacle. For example, it is possible to consider a conventional fixing ring to be screwed onto a neck whose outside is provided with a thread, a portion of the ring forming a recess for receiving a nozzle which itself defines a fixed dispensing orifice. Furthermore, a nozzle mounted on the fixing member must not be considered to be limiting, and provision may also be made for the dispensing orifice 36 to be formed directly by the fixing member, as can be seen in FIG. 2*b*. In short, the dispensing orifice being formed on or a nozzle being mounted on any fixing member also constitutes an advantageous characteristic of the present invention.

The fixing ring 3 also co-operates with the pump body 20 to form a delivery channel 23 which causes the pump chamber to communicate with the nozzle when the outlet valve 7 is open. Advantageously, the fixing ring 3 is covered by trim 9 which extends with a cylindrical skirt 90 over the neck 10 to mask it. At its top end the trim 9 forms an inwardly-extending rim 91 which defines an opening through which the pusher 51 can move. In addition, the skirt 90 is provided with a hole 92 at the nozzle 8.

The process of assembling such a dispenser is explained below with reference to FIGS. 3*a*, 3*b*, and 3*c*. At the end of the production line, the dispensing member 2 and the fixing ring 3 are in the configuration shown in FIG. 3*a*, and the pump body 20 is engaged only partially in the skirt 30 of the ring 3 so that the ferrule 6 is not yet situated at the level of the bulge 22. It is in this configuration that the fixing ring is inserted into the neck 10 of the receptacle. The assembly is inserted into the neck 10 until the bulge 32 comes to be received in the recess 12 formed in the inside wall of the neck 10, as shown in FIG. 3*b*. The ferrule 6 is still not at the level of the bulge 32. The bulge can penetrate into the neck because the fixing ring and the pump body are deformable, unlike the ferrule 6. The last step consists in causing the body 20 to slide inside the skirt 30 until the ferrule 6 reaches the level of the bulge 32. The bulge is then locked definitively in the notch 12. It should be noted, in this embodiment, that the pump body slides inside the skirt 30 of the ring 3 in tight-fitting and leaktight manner so as to form and to isolate the delivery channel 23 which extends laterally between the body 20 and the skirt 30.

In another embodiment shown in FIG. 4, the fixing member for fixing to the inside of the neck 10 is formed directly by the body 20 of the pump 2 whose outside wall forms a bulge 22 suitable for being received in the recess 12 in the neck 10. In this embodiment as well, the ferrule 6, and more particularly the ring 61, is used to lock the bulge 22 definitively in the notch 12. Assembly may be performed in a manner to similar to the manner described above. It is possible to start engaging the pump body 20 into the neck 10 so that the bulge 22 is received in the notch 12, and the ferrule 6 is then engaged by force into the body 20 so as to bring the ring 61 to the level of the bulge 62.

In another embodiment shown in FIG. 5, a fixing ring 3 is used, but the locking ring is formed directly by the body 20 of the pump which is made of a material that is sufficiently rigid to lock the bulge 32 definitively in the notch 12.

In all of the above-described embodiments, a ring is used, whether it be a separate ring 4, the ferrule 6, or the pump body 20, to lock the snap-fastening of the ring 3 or of the body 20 in the neck 10 of the receptacle, the neck being provided with a notch 12.

What is claimed is:

1. A fluid dispenser comprising:

a receptacle (1) containing fluid, said receptacle having a neck (10) defining an inside a dispensing member (2); and a fixing member (3; 2) for fixing the dispensing member (2) to the neck (10) of the receptacle (1);

the fixing member co-operating with the inside wall of the neck, said inside wall of the neck being provided with at least one notch (12) which extends over at least a portion of the periphery of the neck, and the fixing member being provided with snap-fastening means (32; 22) suitable for being received in said notch (12) in the inside wall of the neck, said fixing member being provided with a skirt (30, 20) serving to be engaged in the neck of the receptacle, the snap-fastening means comprising an outside radial projection (32; 22) suitable for coming to be received in said notch in the inside wall of the neck;

said dispenser being characterized in that the snap-fastening means further comprise a locking ring (4; 20; 61) engaged by force in the skirt to the level of the notch (12) in the inside wall of the neck; and wherein the dispensing member has a body (20) which extends in contact with the skirt (30) to the level of its radial projection (32), the locking ring being formed by said body (20).

2. A fluid dispenser comprising:

a receptacle (1) containing fluid, said receptacle having a neck (10) defining an inside wall (11);

a dispensing member (2); and a fixing member (3; 2) for fixing the dispensing member (2) to the neck (10) of the receptacle (1);

the fixing member co-operating with the inside wall of the neck, said inside wall of the neck being provided with at least one notch (12) which extends over at least a portion of the periphery of the neck, and the fixing member being provided with snap-fastening means (32; 22) suitable for being received in said notch (12) in the inside wall of the neck, said fixing member being provided with a skirt (30, 20) serving to be engaged in the neck of the receptacle, the snap-fastening means comprising an outside radial projection (32; 22) suitable for coming to be received in said notch in the inside wall of the neck;

said dispenser being characterized in that the snap-fastening means further comprise a locking ring (4; 20; 61) engaged by force in the skirt to the level of the notch (12) in the inside wall of the neck; and wherein the dispensing member has a body (20) which extends in contact with the skirt (30) to the level of its radial projection (32), the locking ring (61) being formed by a ferrule (6) engaged by force in the body of the dispensing member.

3. A dispenser according to claim 2, in which the ferrule (6) defines the top dead center of the dispensing member.

4. A fluid dispenser comprising:

a receptacle (1) containing fluid, said receptacle having a neck (10) defining an inside wall (11);

a dispensing member (2); and a fixing member (3; 2) for fixing the dispensing member (2) to the neck (10) of the receptacle (1);

the fixing member co-operating with the inside wall of the neck, said inside wall of the neck being provided with at least one notch (12) which extends over at least a portion of the periphery of the neck, and the fixing member being provided with snap-fastening means (32; 22) suitable for being received in said notch (12) in the inside wall of the neck, said fixing member being provided with a skirt (30, 20) serving to be engaged in the neck of the receptacle, the snap-fastening means comprising an outside radial projection (32; 22) suitable for coming to be received in said notch in the inside wall of the neck;

said dispenser being characterized in that the snap-fastening means further comprise a locking ring (4; 20; 61) engaged by force in the skirt to the level of the notch (12) in the inside wall of the neck; and wherein the locking ring is formed by an element (20, 61) of the dispensing member (2); and the body (20) of the dispensing member is slidably received in tight-fitting manner in the skirt (30).

5. A dispenser according to claim 4, in which the dispensing member (2) has a body (20), the fixing member being formed by said body.

6. A dispenser according to claim 4, in which the fixing member (3) is provided with an outside collar (31) serving to come into abutment against the top edge of the neck.

7. The dispenser according to claim 4, in which the fixing member (3) is provided with an outside collar (31) serving to come into abutment against the top edge of the neck with a gasket being interposed.

8. The dispenser according to claim 4, wherein the dispensing member is a pump.

9. A fluid dispenser comprising:

a receptacle (1) containing fluid, said receptacle having a neck (10) defining an inside wall (11);

a dispensing member (2); and a fixing member (3; 2) for fixing the dispensing member (2) to the neck (10) of the receptacle (1);

the fixing member co-operating with the inside wall of the neck, said inside wall of the neck being provided with at least one notch (12) which extends over at least a portion of the periphery of the neck, and the fixing member being provided with snap-fastening means (32; 22) suitable for being received in said notch (12) in the inside wall of the neck, said fixing member being provided with a skirt (30, 20) serving to be engaged in the neck of the receptacle, the snap-fastening means comprising an outside radial projection (32; 22) suitable for coming to be received in said notch in the inside wall of the neck;

said dispenser being characterized in that the snap-fastening means further comprise a locking ring (4; 20; 61) engaged by force in the skirt to the level of the notch (12) in the inside wall of the neck; and wherein the fixing member (3) forms a recess (34) in which a nozzle (8) is received.

10. A dispenser according to claim 9, in which the fixing member (3) forms a swirl chamber and swirl channels (36).

11. A fluid dispenser comprising:

a receptacle (1) containing fluid, said receptacle having a neck (10) defining an inside wall (11);

a dispensing member (2); and a fixing member (3; 2) for fixing the dispensing member (2) to the neck (10) of the receptacle (1);

the fixing member co-operating with the inside wall of the neck, said inside wall of the neck being provided with at least one notch (12) which extends over at least a portion of the periphery of the neck, and the fixing member being provided with snap-fastening means (32; 22) suitable for being received in said notch (12) in the inside wall of the neck, said fixing member being provided with a skirt (30, 20) serving to be engaged in the neck of the receptacle, the snap-fastening means comprising an outside radial projection (32; 22) suitable for coming to be received in said notch in the inside wall of the neck;

said dispenser being characterized in that the snap-fastening means further comprise a locking ring (4; 20; 61) engaged by force in the skirt to the level of the notch (12) in the inside wall of the neck; and wherein the fixing member (3) forms a dispensing orifice (36).

12. A fluid dispenser comprising:

a receptacle (1) containing fluid, said receptacle having a neck (10) defining an inside wall (11);

a dispensing member (2); and a fixing member (3; 2) for fixing the dispensing member (2) to the neck (10) of the receptacle (1);

the fixing member co-operating with the inside wall of the neck, said inside wall of the neck being provided with at least one notch (12) which extends over at least a portion of the periphery of the neck, and the fixing member being provided with snap-fastening means (32; 22) suitable for being received in said notch (12) in the inside wall of the neck, said fixing member being provided with a skirt (30, 20) serving to be engaged in the neck of the receptacle, the snap-fastening means comprising an outside radial projection (32; 22) suitable for coming to be received in said notch in the inside wall of the neck;

said dispenser being characterized in that the snap-fastening means further comprise a locking ring (4; 20; 61) engaged by force in the skirt to the level of the notch (12) in the inside wall of the neck; and wherein the fixing member (3) is covered with a trim band (9).

13. A dispenser according to claim 12, in which the fixing member (3) forms a recess (34) for a nozzle (8), the trim band (9) being provided with a hole (92) at the level of the nozzle.

14. A fluid dispenser comprising:

a receptacle (1) containing fluid, said receptacle having a neck (10) defining an inside wall (11);

a dispensing member (2); and a fixing member (3; 2) for fixing the dispensing member (2) to the neck (10) of the receptacle (1);

the fixing member co-operating with the inside wall of the neck, said inside wall of the neck being provided with at least one notch (12) which extends over at least a portion of the periphery of the neck, and the fixing member being provided with snap-fastening means (32; 22) suitable for being received in said notch (12) in the inside wall of the neck, said fixing member being provided with a skirt (30, 20) serving to be engaged in the neck of the receptacle, the snap-fastening means comprising an outside radial projection (32; 22) suitable for coming to be received in said notch in the inside wall of the neck;

said dispenser being characterized in that the snap-fastening means further comprise a locking ring (4; 20; 61) engaged by force in the skirt to the level of the notch (12) in the inside wall of the neck; and wherein the fixing member (3) forms an outlet channel (35) for the fluid.

15. A fluid dispenser comprising:

a receptacle having a neck defining an inside wall;

a dispensing member; and a fixing member that fixes the dispensing member to the neck; and wherein the inside wall of the neck is provided with a notch that extends over at least a portion of a periphery of the neck;

wherein the fixing member includes a skirt with an outside radial projection received in the notch that snap-fastens the fixing member to the neck;

wherein the fixing member includes a locking ring engaged by force in the skirt to the level of the notch, the locking ring formed by an element of the dispensing member; and wherein a portion of the dispensing member is slidably received in tight-fitting manner in the skirt.

* * * * *